US005579554A

United States Patent [19]

Plazanet

[11] Patent Number: 5,579,554

[45] Date of Patent: Dec. 3, 1996

[54] DRIVE DISK FOR THE TOOL OF A MACHINE FOR THE REPAIR AND/OR MAINTENANCE OF FLOORS

[76] Inventor: Maurice Plazanet, 34, Avenue Jean Racine, 92330 Sceaux, France

[21] Appl. No.: 515,534

[22] Filed: Aug. 15, 1995

[30] Foreign Application Priority Data

Aug. 25, 1994 [FR] France ..... 94 10279

[51] Int. Cl.[6] ..... A47L 11/14

[52] U.S. Cl. ..... 15/98; 15/180; 15/230; 15/230.17; 451/353; 451/359

[58] Field of Search ..... 15/98, 180, 230, 15/230.1, 230.12, 230.15, 230.16, 230.17, 230.18, 230.19; 451/288, 353, 359, 41

[56] References Cited

U.S. PATENT DOCUMENTS

| | | | |
|---|---|---|---|
| 3,072,942 | 1/1963 | Richardson . | |
| 3,464,075 | 9/1969 | Sullivan . | |
| 4,293,973 | 10/1981 | Schar | 15/98 |
| 4,747,176 | 5/1988 | Parks | 15/230.16 |
| 4,999,871 | 3/1991 | Plazanet | 15/230.17 |
| 5,058,229 | 10/1991 | Plazanet | 15/98 |
| 5,081,795 | 1/1992 | Tanaka | 451/288 |
| 5,123,139 | 6/1992 | Leppert | 15/230.17 |
| 5,150,546 | 9/1992 | Tucker | 15/230 |
| 5,230,184 | 7/1993 | Bukham | 451/41 |

FOREIGN PATENT DOCUMENTS

| | | | |
|---|---|---|---|
| 1083775 | 2/1966 | European Pat. Off. . | |
| 0182178 | 5/1986 | European Pat. Off. . | |
| 0347302 | 12/1989 | European Pat. Off. . | |
| 03882730 | 9/1990 | European Pat. Off. . | |
| 861988 | 1/1953 | Germany | 15/180 |

OTHER PUBLICATIONS

Patent Abstracts of Japan–JP63052967–Polishing Device.
Patent Abstracts of Japan–JP2009559–Curved Surface Polishing Device.
Patent Abstracts of Japan–JP6091522–Polishing Device.

*Primary Examiner*—David Scherbel
*Assistant Examiner*—Randall E. Chin
*Attorney, Agent, or Firm*—Fisher, Christen & Sabol

[57] ABSTRACT

Drive disk (1) intended for a machine for the repair and/or maintenance of floors, of the type including a motor capable of rotationally driving at least one rotary tool (2) through the use of a drive shaft (3), said disk being produced from a material which is supple perpendicular to its plane but which is rigid in its plane. According to the invention, the drive disk is noteworthy in that the cavity (10) formed between said rigid circular plate (4) and said diaphragm (5) is leaktight and contains a fluid, especially a liquid, for example water, keeping said diaphragm (5) taut.

4 Claims, 2 Drawing Sheets

DRIVE DISK FOR THE TOOL OF A MACHINE FOR THE REPAIR AND/OR MAINTENANCE OF FLOORS

BACKGROUND OF THE INVENTION

1. Field of the Invention

The present invention relates to a drive disk for the tool of a machine for the repair and/or maintenance of floors.

2. Description of Prior Art

Machines for the repair and/or maintenance of floors, including a motor capable of rotationally driving at least one rotary tool through the use of a drive shaft at least substantially orthogonal to said tool are already known, especially from Patents GB-A-1,083,775 and U.S. Pat. No. 3,464,075, said tool being connected to said drive shaft by a drive disk which, close to its external periphery, is connected to the tool and, close to its center, is connected to the drive shaft, and allowing a relative inclination of limited amplitude of the axis of rotation of the tool with respect to said drive shaft. However, in these known machines, said disk is produced from an elastic material (metal or rubber) so that the degree of freedom of the tool parallel to the axis of the tool is limited by the elasticity of the disk and so that this results in the tool not being exactly coplanar with the floor. As a consequence, the surface being treated is attacked unevenly by said tool so that it cannot be perfectly uniform.

In order to overcome these drawbacks, the document EP-A-0,388,273 describes such a drive disk including a circular diaphragm made of an inelastic material which is supple perpendicular to its plane but which is rigid in its plane.

For example, said diaphragm consists of a web of synthetic material which is rigid in terms of torsional shear. Such a web may, for example, be of the type of those used for producing conveyor belts. It may consist of crossed fabrics made of polyester fibers coated with polyvinyl chloride.

Thus, since the material of said diaphragm is rigid in its plane, the disk can transmit the torque from the drive shaft to said tool, so that the latter is rotationally driven. Moreover, since the material of the diaphragm is supple perpendicular to its plane, such a disk makes it possible, particularly upon start-up, to "uncouple" the tool from the rest of the machine, making it easier to start the tool and to keep the latter perfectly parallel to the floor to be treated, during treatment. In addition, this disk allows the distribution of loads or of forces over the tool, which allows a lateral displacement of the machine.

In use, it has been observed that when such a disk was mounted on a machine imparting to said disk, and therefore to the rotary tool, a high nominal rotational speed, for example of the order of 1000 rpm, the operation of the disk was perfect, without side effects. In contrast, when the disk was mounted on a machine imparting a low nominal speed to it, for example 400 rpm, vibration appeared which was unpleasant for the operator using said machine, even though the latter was doing a good job.

SUMMARY OF THE INVENTION

The object of the present invention is to eliminate the vibration at low speed.

To this end, according to the present invention, the drive disk intended for a machine for the repair and/or maintenance of floors, of the type including a motor capable of rotationally driving at least one rotary tool through the use of a drive shaft, said drive disk including a rigid circular plate and a circular diaphragm, said circular diaphragm, close to its external periphery, being connected to said rigid circular plate and, close to its center, being connected to the drive shaft, and being produced from a material which is supple perpendicular to its plane but which is rigid in its plane, said tool being fixed to said rigid circular plate on the opposite side to said diaphragm, is noteworthy in that the cavity formed between said rigid circular plate and said diaphragm is leaktight and contains a fluid keeping said diaphragm taut.

The applicant has indeed noted that, if the diaphragm was slightly taut, this eliminated the vibration at low speed without having any negative influence on the properties due to the specific nature of the circular diaphragm. He furthermore observed that the new disk could be used satisfactorily both at low rotational speed and at high rotational speed.

Although the following explanation is merely one hypothesis which should have no influence over the patentability of the present invention, the applicant believes that the fluid contained in said cavity and keeping the diaphragm slightly taut acts like a damper preventing bounce, like the liquid contained in a supple hot-water bottle.

Moreover, the applicant has observed that it was advantageous for said fluid to be a liquid and for the density of said liquid to be higher, the lower the nominal rotational speed of said disk. For example, he observed that water, which completely eliminates vibration at 400 rpm, allowed some vibration to remain at 200 rpm, which was eliminated by replacing the water with glycerin.

In order to explain this phenomenon, the applicant believes, without it being possible for this to constitute a condition of validity of the present invention, that it is the action of centrifugal forces on the liquid which determines the amount of damping obtained. The applicant also observed in this regard that in addition to the density of the liquid, the amount of liquid contained in said cavity was also a parameter for setting the elimination of vibration at a given speed.

It may therefore be judicious to fill said cavity to a greater or lesser extent, depending on the rotational speed of the tool and on the density of said liquid.

Moreover, since the means for linking said disk to said drive shaft are borne by the diaphragm, it is necessary for said linking means to be mounted in leak-tight fashion on the central part of this diaphragm.

Said linking means preferably allow easy mounting and/or demounting of said drive disk on and/or from the shaft of the machine. To this end, complementary linking means borne by said drive shaft may be provided in order to form a removable wedging link.

When, in a known manner, the rotary tool includes or alternatively consists of a disk of fibrous material, it is advantageous for said rigid circular plate to include, on its opposite face to said diaphragm, hooks for the fastening of said disk of fibrous material. Such a fastening and fixing system is..advantageously of the type described in Patent EP-A-0,347,302.

BRIEF DESCRIPTION OF THE DRAWING

The figures of the appended drawing make it quite easy to understand how the invention may be produced. In these figures, identical references denote similar elements.

Figure 1:
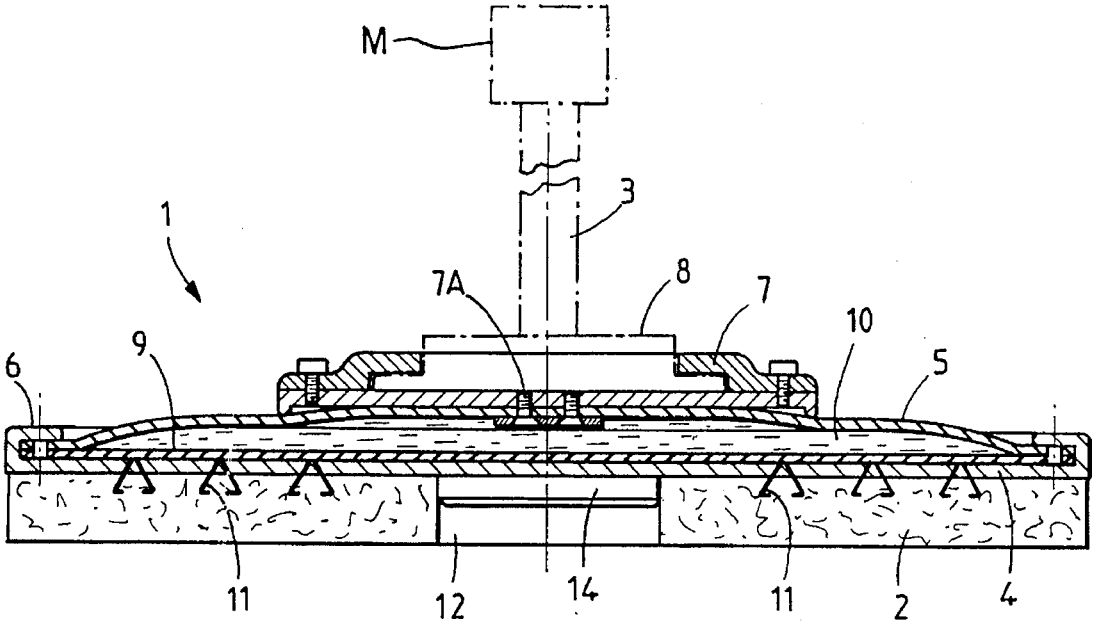
FIG. 1 is a view in diametric section of one embodiment of the drive disk in accordance with the present invention.
Figure 3:
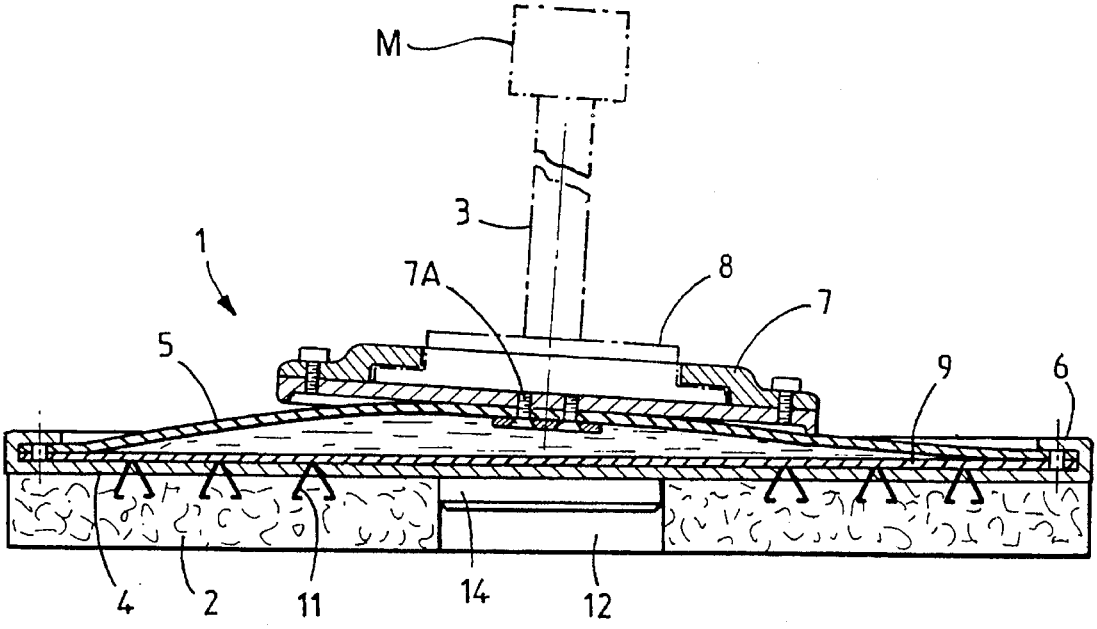
FIG. 3 is a sectional view similar to that of FIG. 1, the drive shaft of the motor being in an inclined position with respect to said tool.
Figure 2:
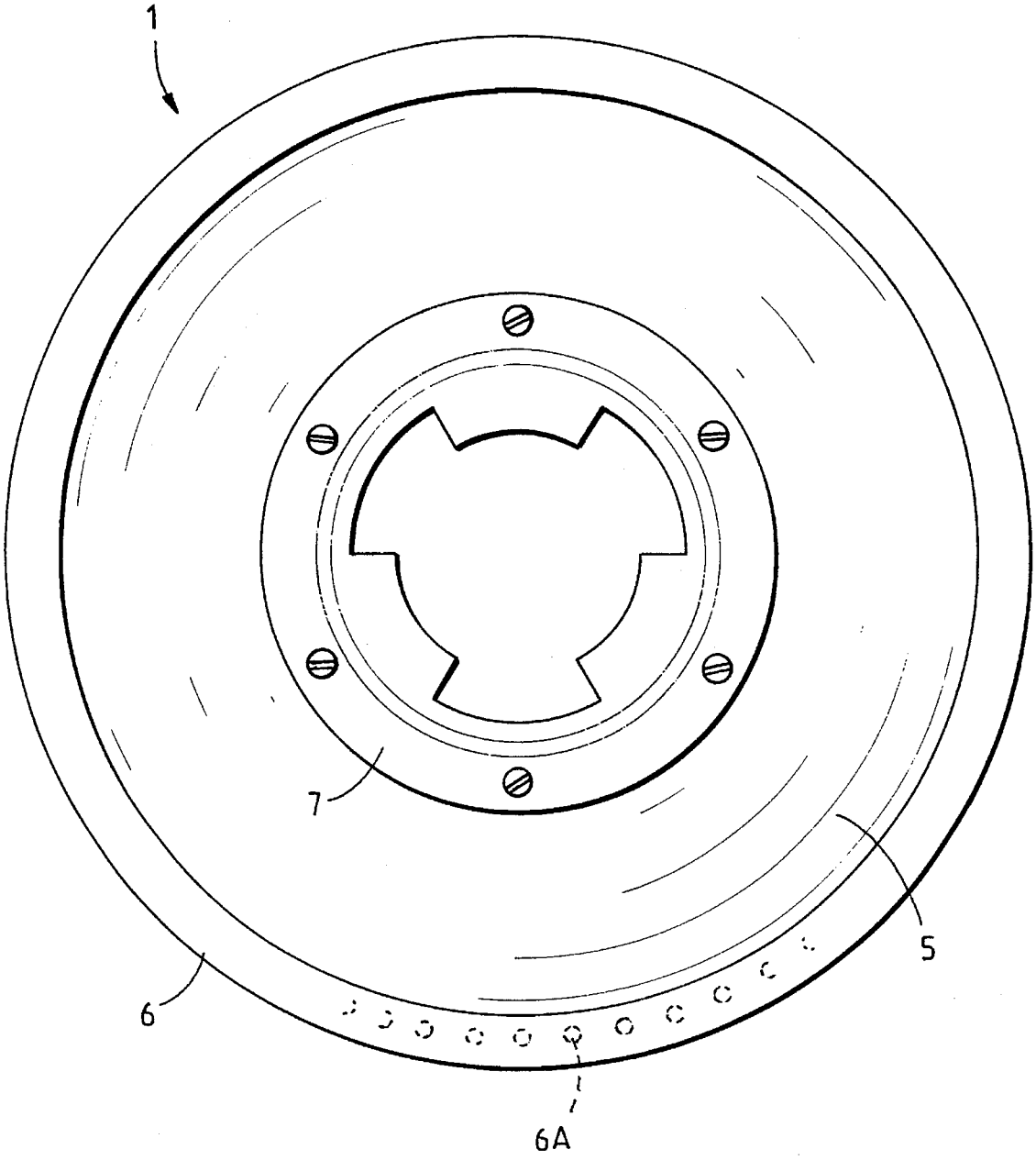
FIG. 2 is a plan view of the disk of FIG. 1.

The drive disk 1 in accordance with the present invention and represented in FIGS. 1 to 3 is intended to be mounted on a machine for the repair and/or maintenance of floors, this machine including a motor M capable of driving a rotary tool 2 through the use of a drive shaft 3.

In FIGS. 1 and 3 it has been assumed that the rotary tool was a disk of fibrous material and the drive shaft 3 has merely been represented in broken lines.

As may be seen in FIGS. 1 and 3, the drive disk 1 includes a rigid circular plate 4 and a circular diaphragm 5. This diaphragm is produced from a material which is supple perpendicular to its plane but rigid in its plane such as, for example, a web of synthetic material which is rigid in torsional shear. Such a web may, for example, be of the type of those used for producing conveyor belts. It may consist of crossed fabric made of polyester fibers coated with polyvinyl chloride.

The circular diaphragm 5 is rendered integral with said rigid plate 4 through the use of clamps 6 and of fixing means 6A, in leaktight fashion, for example by virtue also of an auxiliary membrane 9 pressed against said rigid plate 4 in the vicinity of the external peripheries of said diaphragm and of said rigid circular plate.

Moreover, a female linking clamp 7 is mounted at the center of the diaphragm 5, in leaktight fashion, through the use of fixing means 7A. This female clamp 7 is designed to interact with a male clamp 8 integral with the free end of the drive shaft 3. In FIGS. 1 and 3 this male clamp 8 is represented in broken lines, as is the shaft 3 with which it is integral.

As illustrated especially in FIG. 2, the male and female clamps 7 and 8 form a stud-type link through rotation and wedging.

Thus, since the peripheral link between the diaphragm 5 and the plate 4 is achieved in leaktight manner and since the clamp 7 is mounted in leaktight manner on the diaphragm 5, this results in a leaktight cavity 10 being formed between the diaphragm 5 and the rigid circular plate 4. In accordance with the present invention, a fluid, especially a liquid capable of keeping said diaphragm 5 slightly taut is contained in this leaktight cavity 10, as represented in FIG. 1.

If the floor-treatment machine is designed to drive the rotary disk at a nominal speed of 400 rpm, it is advantageous for said liquid to be water. Thus, at rest, the diaphragm 5 remains slightly taut (see FIG. 1) like a hot-water bottle, while the inclination of the tool 2 is movable with respect to the axis of the shaft 3 but damped by the liquid within cavity 10, as represented in FIG. 3.

In order to fix the fibrous tool 2 to the drive disk 1, the rigid circular plate 4 on its opposite face to the diaphragm 5 has projecting hooks 11 capable of penetrating the fibrous material of the tool 2.

In order to facilitate the fitting of the fibrous tool 2 to the drive disk 1, the tool has a central recess 12 capable of interacting with a projection 14 borne by that face of the rigid circular plate on which said hooks 11 are provided.

I claim:

1. A disk drive (1) comprising a rigid circular plate (4) and a circular diaphragm (5) having an external periphery and a center, the area close to the external periphery of said circular diaphragm (5) being connected to said rigid circular plate (4) and, the area close to the center of the circular diaphragm being adapted to be connected to a drive shaft (3), and being produced from a material which is supple perpendicular to its plane but which is rigid in its plane, a cavity (10) being formed between said rigid circular plate (4) and said diaphragm, wherein the cavity (10) formed between said rigid circular plate (4) and said diaphragm (5) is leaktight and contains a liquid fluid keeping said diaphragm (5) taut, said rigid circular plate (4) having two faces, one of which is opposite to said diaphragm (5), and further comprising a tool (2) which is fixed to said rigid circular plate (4) on the opposite side of said diaphragm (5).

2. The drive disk as claimed in claim 1, wherein the lower the nominal rotational speed of the drive is, the higher the density of said liquid is.

3. The drive disk as claimed in claim 1, the nominal rotational speed of which is of the order of 400 rpm wherein said liquid is water.

4. The drive disk as claimed in claim 1, further including: a disk of fibrous material, wherein the face of said rigid circular plate (4) which is opposite to said diaphragm (5) includes hooks (11) for the fastening of said disk of fibrous material.

* * * * *